United States Patent [19]

Vassiliou

[11] 4,047,480

[45] Sept. 13, 1977

[54] LONGITUDINALLY FLEXIBLE SQUEEGEE AND MOUNTING STRIPS THEREFOR

[75] Inventor: Eustathios Vassiliou, Newark, Del.

[73] Assignee: E. I. Du Pont de Nemours and Company, Wilmington, Del.

[21] Appl. No.: 710,103

[22] Filed: July 30, 1976

[51] Int. Cl.[2] ..... B41F 15/44

[52] U.S. Cl. ..... 101/123; 15/245; 15/250.36; 101/124

[58] Field of Search ..... 101/114, 119, 123, 120, 101/124; 15/245, 250 A, 250.36; 401/9

[56] References Cited

U.S. PATENT DOCUMENTS

| | | | |
|---|---|---|---|
| 2,952,865 | 9/1960 | Rohr et al. | 15/250.36 |
| 3,180,255 | 4/1965 | Christie | 101/123 |
| 3,825,971 | 6/1972 | Ursel et al. | 15/250 A X |
| 3,943,849 | 3/1976 | Vasilantone | 101/122 |

*Primary Examiner*—J. Reed Fisher
*Assistant Examiner*—R. E. Suter

[57] ABSTRACT

A flexible squeegee for use in round or irregularly shaped screen-printing frames, whose design permits it to sweep all, or substantially all, of the screen surface.

3 Claims, 5 Drawing Figures

LONGITUDINALLY FLEXIBLE SQUEEGEE AND MOUNTING STRIPS THEREFOR

BACKGROUND OF THE INVENTION

Stencil screen-printing, or silk-screen printing as it is sometimes called, is widely used to impress decorative images on paper or canvas in art work, or on metal or ceramics in industrial operations such as the manufacture of dishware.

In this technique, a permeable image is formed on an otherwise non-permeable cloth. The permeable image portion of the cloth permits the ink to flow through to the substrate beneath, while the non-permeable portion holds the ink back. The ink is ordinarily forced through the permeable image portion by pressure applied with a squeegee.

In industrial screen-printing operations, the printing is customarily done with a machine in which the image-bearing cloth is mounted on a square or rectangular frame. Ink is placed in this frame and a straight, rigid squeegee is then automatically swept over the screen, squeezing the ink through the permeable image portion of the screen and on the work.

Such apparatus is obviously unsuited for decorating work which requires a round or irregularly shaped frame. When used with such a frame, the rigid squeegee cannot reach the far edges of the screen because its ends become locked against the side of the frame as the squeegee stroke proceeds from the center of the frame to the sides. This may leave a portion of the permeable image portion of the screen without ink.

An apparatus has been developed which uses a flexible blade held by several swivelly mounted clamps actuated by chains and cams which bend the blade into an arc as it goes through its lateral stroke and straighten it as it returns to the center. This permits the squeegee to reach the periphery of the screen and allows the entire image area to be covered. Such an apparatus is the American Dubuit Silk Screen Printer, sold by the American Screen Printing Equipment Co., of Chicago, Ill.

This apparatus generally works well, but is complex and costly. Moreover, each frame size, with some tolerance, requires a different squeegee with its own set of cams, so much time is lost in removing cams and installing others when the frame size is changed. Furthermore, the apparatus, because of its bulk, cannot be used to impress images on work having high sides, such as deep dishes or saucepans.

In contrast, the squeegee of the invention is simple, inexpensive, easy to remove from and install in screen printing machines, and, because of its small size, can be used to great advantage on "deep" work. In addition, when frame sizes are changed, the only thing required is replacement of the original squeegee with a larger or smaller one of the same design.

SUMMARY OF THE INVENTION

Figure 1:
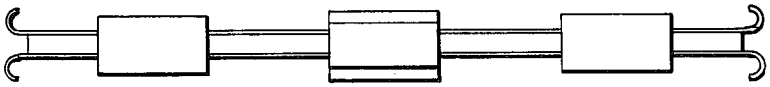
FIG. 1 is a top plan view of the squeegee of the invention.
Figure 2:
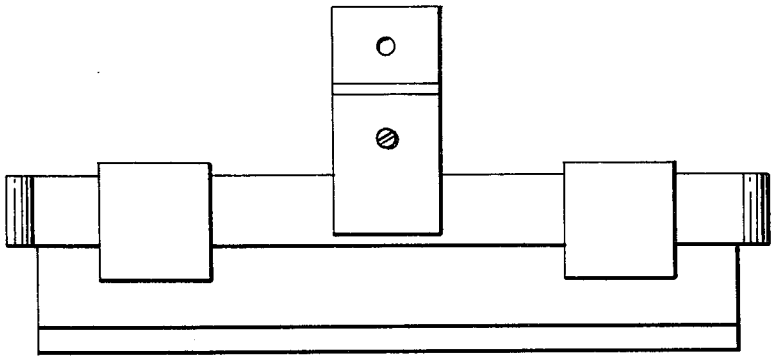
FIG. 2 is a front elevational view of the same.
Figure 3:
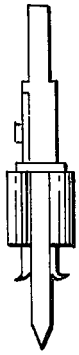
FIG. 3 is a end elevational view.
Figure 4:
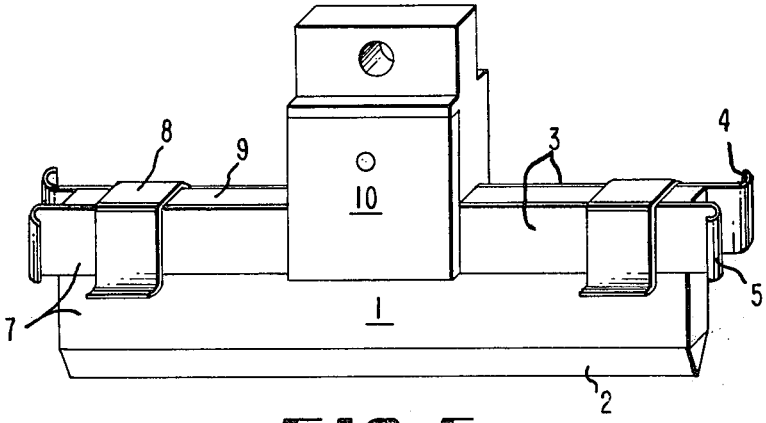
FIG. 4 is a front perspective view.

As seen in FIG. 4, the working portion of the squeegee is the blade 1, which can be brought to a knife-like edge 2 if desired. The blade can be of any flexible material customarily used for squeegee blades. This material must, of course, resist attack by the ink used. Rubber or polyurethane is the material ordinarily used.

The blade is positioned between two flat resilient support strips 3, of about equal length, which lie in register and which, in the complete assembly, lie in parallel or substantially parallel planes. These strips engage the blade snugly so that the blade is held firmly between the strips, but not so snugly that lateral sliding of each face of the blade against its corresponding strip is restricted. The supporting strips can be made of any resilient material capable of withstanding the stresses placed on it in use. It can, for example, be of plastic or metal, and is preferably made of light gauge spring steel.

Figure 5:
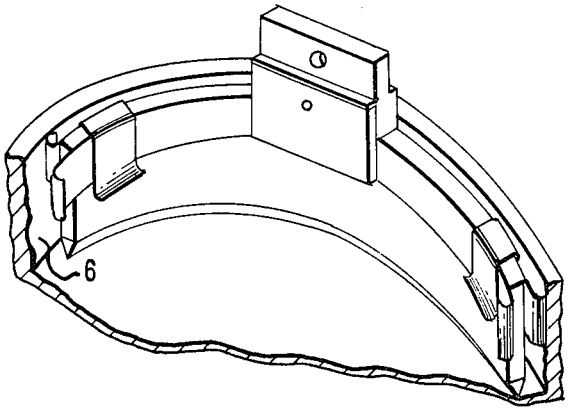
FIG. 5 is a front perspective view of the squeegee being used in a circular frame.

The end edges 4 of the supporting strips project beyond the ends of the blade and are preferably turned outwardly and back to form at least about a quarter-round 5. The edges engage the sides of the frame 6, as shown in FIG. 5, thus bending the blade into an arc as it goes through its lateral stroke. The resiliency of the supporting strips brings the blade back into its straight configuration when pressure on their edges is released on the reverse stroke. When the edges engage the opposite side of the frame on the reverse stroke, the sequence is repeated.

The blade, together with the supporting strips, form a blade/strip assembly 7 held together by at least two channel bars 8, which lie astride the assembly. These bars fit over the top edge 9 of the assembly, so that the parts are held snugly together, but not so snugly that the blade and supporting strips are prevented from sliding against one another. The number, width and length of these bars is governed by the flexibility of the blade, its length and its width. The more flexible the blade is, and the longer and wider it is, the longer and wider the bars must be, and the more of them.

At least one bar 8, must be on each side on the assembly's vertical center, preferably symmetrically arranged. One side of each bar is immovably attached to one of the support strips but not to the other, so that the blade and the unattached strip can move freely in the channel when the blade and strip are bent.

The squeegee assembly can be attached to a handle or to a screen-printing machine by mounting means 10 positioned at about the vertical center of the blade/strip assembly and attached to it by a clamp or other equivalent means, such as a bolt or a welded joint.

I claim:

1. A squeegee comprising a flexible blade positioned between and projecting downwardly from two flat resilient support strips of about equal length which lie in register and whose flat sides lie in parallel planes, the strips projecting beyond the ends of the blade, to form a blade/strip assembly; a plurality of short channel bars positioned astride the assembly, snugly fitting and so spaced along its top edge that at least one bar is on each side of the assembly's longitudinal center, one side of each bar being immovably attached to one support strip but not the other;

and means for mounting the assembly.

2. The squeegee of claim 1 wherein the end edges of the support strips are turned outwardly to form at least a quarter-round.

3. The squeegee of claim 1 wherein the mounting means is attached to the blade/strip assembly with a clamp.

* * * * *